US005547300A

United States Patent [19]

Powers

[11] Patent Number: 5,547,300

[45] **Date of Patent: *Aug. 20, 1996**

[54] COSMETIC PENCIL WITH THREADS POSITIONED ON FLEXIBLE ARMS

[76] Inventor: Ronald J. Powers, 550 E. Third St. #B., Oxnard, Calif. 93030

[ * ] Notice: The term of this patent shall not extend beyond the expiration date of Pat. No. 5,407,286.

[21] Appl. No.: 331,127

[22] Filed: Oct. 28, 1994

Related U.S. Application Data

[63] Continuation-in-part of Ser. No. 169,213, Dec. 20, 1993, Pat. No. 5,407,286.

[51] Int. Cl.[6] ..... A45D 40/06; A45D 40/20

[52] U.S. Cl. ..... 401/68; 401/75; 401/76; 401/86

[58] Field of Search ..... 401/68, 75, 76, 401/70, 73, 79, 86

[56] References Cited

U.S. PATENT DOCUMENTS

| | | | |
|---|---|---|---|
| 3,106,908 | 10/1963 | Gretz | 401/70 X |
| 3,115,118 | 12/1963 | Anderson et al. | 401/75 |
| 3,209,730 | 10/1965 | Aston | 401/76 |
| 3,232,276 | 2/1966 | Kupersmith et al. | 401/75 X |
| 5,407,286 | 4/1995 | Powers | 401/68 |

FOREIGN PATENT DOCUMENTS

| | | | |
|---|---|---|---|
| 2119320 | 11/1983 | United Kingdom | 401/75 |

*Primary Examiner*—Steven A. Bratlie
*Attorney, Agent, or Firm*—Edgar W. Averill, Jr.

[57] ABSTRACT

A cosmetic pencil for dispensing a soft cosmetic mass. A lower barrel holds an elongated push rod which has external threads which move outwardly of the lower barrel when it is turned with respect to a hollow sheath. The cosmetic mass is held in the hollow sheath and two flexible arms at the base of the hollow sheath contact the external threads on the push rod. In this way the push rod may be inserted radially between the flexible arms and need not be threaded in from the bottom of the flexible arms.

6 Claims, 1 Drawing Sheet

COSMETIC PENCIL WITH THREADS POSITIONED ON FLEXIBLE ARMS

CROSS-REFERENCE TO RELATED APPLICATION

This application is a continuation-in-part of applicant's application, Ser. No. 08/169,213 filed Dec. 20, 1993, entitled "Cosmetic Pencil" now U.S. Pat No. 5,407,286.

BACKGROUND OF THE INVENTION

The field of the invention is cosmetic applicators and the invention relates more particularly to cosmetic pencils for dispensing a soft cosmetic mass such as an eyeliner crayon.

A cosmetic pencil of the general type disclosed herein is shown in applicant's U.S. Pat No. 4,696,594. In this device a push head cylinder 27 is placed within the sheath member prior to filling with a cosmetic mass and the push rod 22 contacts its head. The push rod is advanced by an off-centered disk. While this construction has been very satisfactory, it does require that the sheath be filled from the front and it is advantageous that it be filled from the rear. It is also advantageous that there be some method of retracting the cosmetic mass when it is not in use. It is further advantageous that the push rod be assembled without having to thread it in from the bottom of the sheath portion of the applicator.

Several cosmetic applicators utilize a threaded push rod which advances outwardly from a barrel. One such device is shown in U.S. Pat No. 2,563,943. Another design is shown in U.S. Pat No. 3,219,044. A piston is used in U.S. Pat No. 3,468,612 to push a liquid cosmetic mass outwardly from a cartridge. U.S. Pat No. 2,274,311 shows a push rod within a barrel which is used to advance a rectangular lead or crayon. U.S. Pat No. 3,209,730 shows an automatic pencil which utilizes a threaded end with an elongated aperature 64. The purpose of this aperature as shown best in FIG. 4 of the drawings is to permit a clutch action wherein the threaded end can move outwardly as shown in FIG. 4 and permit the turning of feed screw 16 even though there is no advance of crayon 25.

SUMMARY OF THE INVENTION

It is an object of the present invention to provide a cosmetic pencil which has a threaded push rod which can be assembled without turning the push rod into mating threads.

The present invention is for a cosmetic pencil for dispensing a soft cosmetic mass. The pencil has a generally cylindrical elongated hollow lower barrel. An elongated push rod is held in the barrel so that it may move axially along the longitudinal axis of the barrel, but cannot turn in the barrel. The push rod has external threads thereon and includes means for preventing the push rod from being turned within the lower barrel. A hollow sheath is rotatingly held by the lower barrel and the sheath has two opposed arms at its inner end. The opposed arms are sufficient flexible to permit the passage of the head of the push rod between them. When the hollow sheath is inserted into the barrel, the flexible arms are in contact with the inner surface of the lower barrel so that they are maintained in contact with the external threads on the push rod. A generally cylindrical length of soft cosmetic mass is supported in the hollow sheath and is pushed out of the hollow sheath by turning the lower barrel and the push rod thereby extending the push rod upwardly out of the lower barrel and pushing the soft cosmetic mass out of the hollow sheath.

DESCRIPTION OF THE PREFERRED EMBODIMENTS

Figure 1:
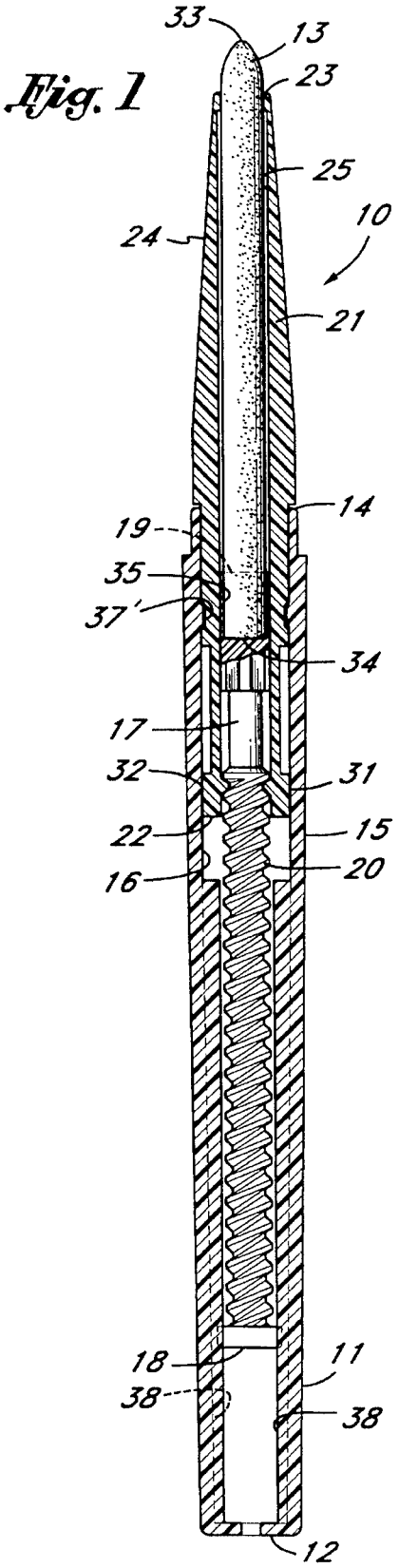
FIG. 1 is a cross-sectional view of the cosmetic pencil of the present invention.

The cosmetic pencil of the present invention is shown in cross-sectional view in FIG. 1 and indicated by reference character 10. Cosmetic pencil 10 has a lower barrel 11 which is hollow and has a bottom 12, an outer surface 15 and an inner surface 16. A sheath 21 is rotatingly held near the top 14 of lower barrel 11 by any appropriate means. The means shown in the drawings consist of a groove 37 and a ring 37' which snap together to allow the sheath 21 to turn with respect to lower barrel 11. A push rod 17 is positioned within the inner surface 16 of lower barrel 11. Push rod 17 has a bottom portion 18 which is shaped so that it will contact a pair of ridges 38 and will not turn with respect to lower barrel 11. Thus, as lower barrel 11 is turned with respect to sheath 21, the push rod 17 will turn with the lower barrel because of the contact between the bottom portion 18 and ridges 38. A length of cosmetic mass 13 is held within sheath 21. Preferably the inner surface 25 of sheath 21 is recessed so that the cosmetic mass will easily move inwardly and outwardly with respect to sheath 21. The bottom 34 of cosmetic mass 13 is preferably captured in a cup 35 shown best in FIG. 3 so that the tip 33 of the cosmetic mass can be withdrawn below the top 23 of sheath 21.

Figure 2:
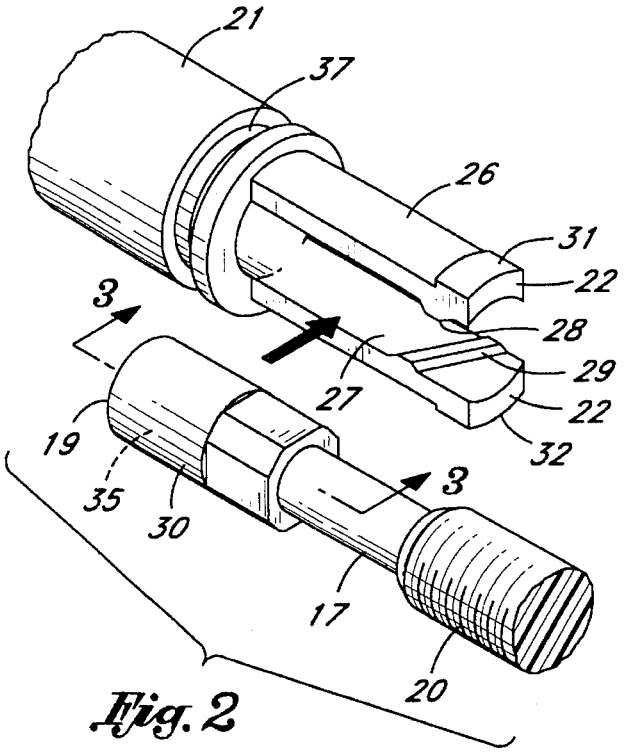
FIG. 2 is an exploded perspective view of the lower portion of the sheath and the upper portion of the push rod of the cosmetic pencil of FIG. 1.
Figure 3:
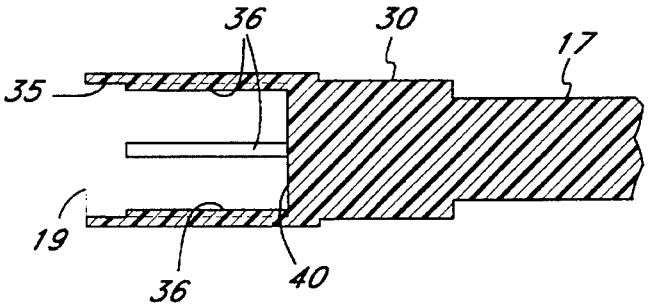
FIG. 3 is an enlarged cross-sectional view taken along line 3—3 of FIG. 2.

The essential feature of the cosmetic pencil of the present invention is shown best in FIG. 2 of the drawings where it can be seen that the bottom 22 of sheath 21 is equipped with a pair of opposed arms 26 and 27. These arms are flexible since the sheath is fabricated from a flexible polymer such as acrylonitrile butadiene styrene (ABS). Opposed arm 26 has a thread portion 28 on its inner surface and opposed arm 27 has a thread portion 29 on its inner surface. Arm 26 has an outer surface 31 which contacts inner surface 16 of lower barrel 11. The external threads 20 on push rod 17 mate with thread portions 28 and 29 so that the push rod 17 moves upwardly and downwardly as the lower barrel 11 is turned with respect to sheath 21. These arms 26 and 27, however, are flexible enough so that the enlarged head 30 of push rod 17 may be moved in between arms 26 and 27 axially as indicated by the arrow in FIG. 2. In this way, an enlarged head 30 can be used without the necessity of it passing over thread portions 28 and 29. The flexible arms are retained against external threads 20, however, as shown in FIG. 1 so that a secure vertical movement of push rod 17 will occur. In this way a thread which covers less than about half of the circumference is still completely satisfactory for advancing and retracting the cosmetic mass. Furthermore, multiple threads on each side are not required and a single thread as shown in FIG. 2 is operable. Preferably, keys or ridges 36 are provided on the inner surface of cup 35 as shown in FIG. 3 so that the cosmetic mass will turn with push rod 17 within sheath 21.

To operate the cosmetic pencil the outer surface 24 of sheath 21 is grasped by the user and the lower barrel 11 is twisted with respect to the sheath 21. As the lower barrel is twisted in a clockwise direction the tip 33 of cosmetic mass 13 moves outwardly with respect to the top 23 of sheath 21. Conversely, when the lower barrel 11 is twisted counter clockwise with respect to sheath 21, the tip 33 will move inwardly and can be retracted completely below top 23 of sheath 21. In this way the cosmetic mass can be easily retracted. The cosmetic mass preferably contacts the entire length of cup 35 from its bottom 40 to its top 19. This gives a sufficiently secure grasp of cosmetic mass 13.

While enlarged head 30 is shown as an integral part of push rod 17 it can, of course, be a separate part snapped on the upper end of push rod 17. Note also that the top 23 of sheath 21 is extended inwardly with respect to inner surface 25. In this way the top 19 of push rod 17 cannot be extended out beyond the top 23 when the cosmetic mass is completely extended. Also, this inner surface 25 provides almost no resistance to the turning and extension of cosmetic mass 13 in sheath 21.

The net result is a cosmetic pencil having very few parts and yet which may be completely retracted, easily assembled and easy to use. Preferably external threads 20 are of a relatively steep pitch and are preferably a multiple start thread. For instance, a four start thread having a 0.0625 pitch and a 90° thread angle has proved successful. A two start thread is shown in FIG. 8 of the drawings having a 0.0625 pitch and an 80° thread angle. In this way the cosmetic mass will move outwardly with a minimum degree of turning.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A cosmetic pencil 10 for dispensing a soft cosmetic mass 13, said cosmetic pencil comprising:

a generally cylindrical elongated hollow lower barrel 11 having a bottom 12, a top 14, an outer surface 15 and an inner surface 16;

an elongated push rod 17 supported by said hollow barrel 11 so that it may more axially of said barrel but cannot turn in said barrel, said elongated push rod 17 having a bottom 18 and a top 19 and having external threads 20 and including means to prevent said push rod from being turned with respect to said barrel 11, said elongated push rod 17 having a head 30 adjacent the top 19 to assist in pushing a cosmetic mass 13 out of a sheath 21;

a hollow sheath 21 rotatingly held by said barrel 11 having a bottom 22, a top 23 an outer surface 24 and an inner surface 25, said sheath having at least two opposed arms 26 and 27, each having at least one thread portion 28 and 29 which mates with the external threads 20 of push rod 17, said opposed arms being sufficiently separated and flexible to permit the passage of the enlarged head 30 between them from a radial direction when the sheath 21 is out of the lower barrel 11 and at least one of said at least two opposed arms 26 and 27 having an outer surface 31 and 32 which contacts the inner surface 16 of said hollow barrel 11 when it is inserted in said barrel to prohibit the at least one thread portion 28 and 29 from moving out of contact with the elongated push rod 17; and a generally cylindrical length of a soft cosmetic mass 13 supported in said hollow sheath 21 having a tip 33, a bottom 34 and a length, said tip 33 being extendable out of the top 23 of the hollow sheath 21 and the bottom 34 being in contact with the enlarged head 30 of said elongated push rod 17.

2. The cosmetic pencil of claim 1 wherein enlarged head 30 includes an integral cup 35 for holding the bottom 34 of said length of soft cosmetic mass 13.

3. The cosmetic pencil of claim 1 wherein there is a pair of opposed arms 26 and 27.

4. The cosmetic pencil of claim 3 wherein both of the opposed arms 26 and 27 have an outer surface 31 and 32 which are in contact with the inner surface 16 of the hollow barrel 11.

5. The cosmetic pencil of claim 4 wherein both of the opposed arms 26 and 27 have a single thread portion 28 and 29.

6. The cosmetic pencil of claim 1 wherein the external threads 20 are coarse threads and the inner surface 25 of the hollow sheath 21 is recessed along essentially the entire length of the inner surface except at the top 23 whereby the cosmetic mass may be retracted into the hollow sheath.

* * * * *